US011021942B2

(12) United States Patent
Eichhorn et al.

(10) Patent No.: US 11,021,942 B2
(45) Date of Patent: Jun. 1, 2021

(54) METHODS OF MANAGING SOLVENT INVENTORY IN A GRAVITY DRAINAGE EXTRACTION CHAMBER

(71) Applicant: Hatch Ltd., Mississauga (CA)

(72) Inventors: Mark Anthony Eichhorn, Oakville (CA); Paul Krawchuk, Calgary (CA); Gharandip Singh Bawa, Calgary (CA); Adam Douglas Blackmore, Oakville (CA); Cassandra Amanda Lee, Toronto (CA)

(73) Assignee: Hatch Ltd., Mississauga (CA)

( * ) Notice: Subject to any disclaimer, the term of this patent is extended or adjusted under 35 U.S.C. 154(b) by 0 days.

(21) Appl. No.: 16/629,682

(22) PCT Filed: Jul. 17, 2018

(86) PCT No.: PCT/CA2018/000142
§ 371 (c)(1),
(2) Date: Jan. 9, 2020

(87) PCT Pub. No.: WO2019/014745
PCT Pub. Date: Jan. 24, 2019

(65) Prior Publication Data

US 2020/0378228 A1 Dec. 3, 2020

(30) Foreign Application Priority Data

Jul. 18, 2017 (CA) ..... CA 2973710

(51) Int. Cl.
*E21B 43/24* (2006.01)
*E21B 47/07* (2012.01)

(52) U.S. Cl.
CPC ..... *E21B 43/2408* (2013.01); *E21B 43/2401* (2013.01); *E21B 43/2406* (2013.01); *E21B 47/07* (2020.05)

(58) Field of Classification Search
CPC .. E21B 43/2406; E21B 43/2401; E21B 47/07; E21B 43/16; E21B 43/166; E21B 43/168; E21B 43/2408
See application file for complete search history.

(56) References Cited

U.S. PATENT DOCUMENTS

2003/0015458 A1* 1/2003 Nenniger ..... E21B 43/34 208/428
2011/0253368 A1 10/2011 Banerjee et al.

FOREIGN PATENT DOCUMENTS

CA 2 281 276 A1 2/2001
WO 2008/144934 A1 12/2008
WO 2012/067613 A1 5/2012

OTHER PUBLICATIONS

Nima Rezaei (2010). Experimental investigations in improving the VAPEX performance for recovery of heavy oil and bitumen. UWSpace. http://htdLhandle.net/10012/5553 *p. 5-7,p. 32-33,p. 35-37.

(Continued)

*Primary Examiner* — George S Gray
(74) *Attorney, Agent, or Firm* — Vidas, Arrett & Steinkraus, P.A.

(57) ABSTRACT

A method of managing a liquid solvent inventory in a condensing solvent gravity drainage extraction chamber includes growing the extraction chamber by injecting a solvent vapour under conditions which cause at least a portion of the solvent vapour to condense on a hydrocarbon extraction interface at a condensation temperature, then accumulating within the extraction chamber condensed liquid solvent which is draining through the chamber under the influence of gravity, which liquid solvent includes a hydrocarbon rich fluid production layer which is proximal to said extraction interface, and then heating a portion of the extraction chamber from a location near, in and/or above the injector to create a heated zone having a temperature above (Continued)

the condensation temperature without heating the hydrocarbon rich production layer to permit the hydrocarbon rich production layer to continue to drain to a production well.

31 Claims, 11 Drawing Sheets

(56) References Cited

OTHER PUBLICATIONS

A Cao, K (2014) , A Numerical Simulation Study of the N-SolvTM Process, https://prism.ucalgary.ca/handle/11023/1602 *p. 127-131*.

* cited by examiner

METHODS OF MANAGING SOLVENT INVENTORY IN A GRAVITY DRAINAGE EXTRACTION CHAMBER

CROSS REFERENCE TO RELATED APPLICATIONS

This application is a National Stage Application pursuant to 35 U.S.C. 371, claiming priority to PCT Application Number PCT/CA2018/000142 filed on Jul. 18, 2017.

FIELD OF THE INVENTION

This invention relates generally to the field of hydrocarbon extraction and most particularly to EOR (Enhanced Oil Recovery) as applied to unconventional resources such as the Canadian oil sands. One type of EOR is a solvent based in situ gravity drainage extraction process. In particular, this invention relates to methods for managing a condensing solvent in situ gravity drainage extraction process. Most particularly this invention relates to methods and apparatuses which may be used to manage or optimize the amount of solvent required in a formed extraction chamber.

BACKGROUND OF THE INVENTION

Many attempts have been made to extract in situ hydrocarbons from deposits which do not readily flow at reservoir conditions, such as the Canadian oil sands, by using various EOR processes. One such process is SAGD which requires the injection of large volumes of super heated steam to try to mobilize in situ hydrocarbons. Although SAGD has been made to work, it has some undesirable characteristics because it requires water/steam heated to high temperatures (often more than 200 C) which in turn requires burning a lot of fuel to generate the heat to get to the steam temperatures required to make SAGD work. Extraction can be achieved, but at a high greenhouse gas emissions cost. Another process is called VAPEX which involves the injection of a mixed gas comprising a solvent and a carrier gas, such as methane. A problem with VAPEX is that it is too slow to be commercially viable. Another process is called SAVEX which starts as a SAGD process and later transitions to VAPEX in a form of hybrid process. This process requires both a sizeable steam plant and a solvent plant which increases the capital costs of the facility.

In CA 2,351,148, directed to the Nsolv® condensing solvent extraction process, Nenniger taught injecting solvent into the extraction chamber at a temperature and pressure sufficient for the solvent to be a vapour in the chamber and to condense to a liquid on the extraction surface, and to control the extraction temperature and pressure to achieve bubble point conditions to permit continued solvent condensation at the extraction surface. The bubble point conditions are achieved at least in part by limiting the presence of non-condensable gases within the chamber in general and in particular adjacent to the extraction interface where condensation of the solvent onto the bitumen is to occur. Solvent condensation releases the latent heat of condensation. When this occurs in the chamber at the extraction surface, the heat flux from condensing solvent to the bitumen heats the bitumen, causing the bitumen viscosity to decrease. As well, the solvent dissolves into the bitumen for a further viscosity reduction. Under the right conditions a solvent/hydrocarbon blend will have a low enough viscosity to drain by gravity into a lower producer well, simply through the combined solvent/thermal effects on viscosity. From there, the blend can be produced to surface and separated, in a surface facility, into sales oil and recovered solvent. The recovered solvent can then be recirculated back down into the extraction chamber to condense again. CA 2,351,148 teaches the heat flux due to solvent condensation is constant per unit of solvent injected, therefore, as the extracted chamber grows and the extraction surface area increases, higher solvent injection rates will be required.

In CA 2,639,851, Nenniger also comprehended that as the chamber grows in size, the heat losses to the overburden will increase and this has the effect of increasing the solvent to oil ratio. In oil sands deposits the pay zone is typically in a thin layer which covers a large geographic area. As a gravity drainage process creates an in situ extraction chamber the extracted zone may first rise above the horizontal well pair towards the over burden and then further extraction takes place laterally away from the source of the solvent, namely the injection well in the horizontal well pair. This lateral chamber growth exposes more and more of the overburden to the condensing solvent conditions. Basically, any solvent condensing on the overburden is condensing in a non-productive way as it is condensing not at the extraction interface where it can transfer heat to mobilize and extract bitumen, but instead on the unyielding overburden. Solvent condensing due to overburden heat losses must drain down as a liquid through the solvent chamber, thereby contributing to the total amount of liquid solvent in the chamber, but as noted above this liquid solvent is not directly assisting in further bitumen extraction. Essentially any condensation that occurs not on the extraction interface is unproductive, in the sense that it is not helping to mobilize any fresh bitumen for extraction. An increase in solvent to oil ratio means a bigger surface plant is required with larger capital costs to recirculate the larger solvent volumes. As well if more of the extraction chamber is filled with liquid rather than vapour solvent, more total solvent mass is required due to the lower specific volume of the liquid form. The solvent can be recovered and reused, but the solvent also has an inherent cost. If more solvent is caught up as liquid in the chamber and more solvent is required, then the costs of supplying the extra solvent will have to be met by the operator. So, reducing the non-productive portions of solvent to oil ratio and solvent inventory would also help reduce the operating costs and the total amount of solvent required and therefore the total solvent cost during solvent injection and before solvent recovery during chamber blowdown.

One possible solution for this problem was provided in CA 2,281,276 to Suncor directed to a so called "Thermal Solvent" process. In this process a local heat source is provided in the reservoir along the lower production well to create a hot zone which in theory allows the solvent to reflux up to the extraction interface at the edge of the chamber, condense, and then return to the hot zone where it flashes to reflux up again. The heat source described is a closed steam loop which creates a hot zone in the areas of the reservoir around the heat source. The draining liquid solvent simply comes into contact with the hot zone and then flashes off as a vapour. It is believed that this Thermal Solvent process was piloted in the field but without much success. One problem may have been although in concept this process is theoretically frugal in terms of total solvent required, the solvent has no way to get to the production well without crossing the hot zone at the lower production well. This means that non-condensable gases such as formation gas from the reservoir cannot get past the hot zone either. As taught by Nenniger this will trap the non-condensable gases in the chamber leading to less and less direct contact between the solvent vapour and the bitumen leading to ever declining bitumen mobilization, until the material balance means that extraction will effectively stop. This will occur at the point when the solvent simply refluxes between the hot zone and a non-condensable gas cloud that has built up above the hot zone, without coming into contact with the extraction interface.

Another possible problem lies with the reflux step. As the solvent flashes off the draining solvent bitumen blend there will be a rapid decrease in mobility of the bitumen. It is possible that the diluted bitumen will be transported to a specific location within the extraction chamber, then the hot zone will cause a flash off of solvent thereby greatly increasing the viscosity of the bitumen and the counter current vapour flux reducing the effective permeability of oil. This may lead to a build up of a slow draining region just at the periphery of the hot zone, where the solvent flashes. Such an immobile region can interfere with draining fluids preventing them from reaching the production well. So, although the "Thermal Solvent" approach has been suggested it does not appear to be an attractive alternative.

Another method of decreasing the solvent to oil ratio was briefly mentioned in "A Numerical Simulation Study of the N-Solv™ Process" by K. Cao. K. Cao's simulations predicted that injecting superheated propane would result in an improved (reduced) solvent to oil ratio, with a slightly reduced cumulative oil production.

What is desired is a method or process that can address the need to be efficient in terms of the amount of solvent used in situ, one which allows the draining fluids to drain and the non-condensable off gases and impurities to be removed as taught by Nenniger, and does not adversely affect cumulative oil production.

SUMMARY OF THE INVENTION

What is desired therefore are methods to reduce the amount of liquid solvent which may be present in the extraction chamber and to reduce the solvent to oil ratio of the process. Preventing solvent from condensing in unproductive areas such as in the internal casing of the well bore, the already extracted zone in the chamber or even parts of the overburden, may also be desirable to reduce operating and capital costs. It may further be desirable to have methods to mitigate the increased solvent demand due to heat loss to unproductive areas and short-circuiting as the chamber grows in size, as with a larger size such effects may become ever more dominant. It may be desirable to allow non-condensable gasses to be removed from the chamber during such a process as well as limiting the demobilization of bitumen in inopportune locations by flashing off the solvent in situ from a mixed draining fluid. The present invention may address some of the issues of the prior processes through careful attention to process parameters and extraction chamber dynamics.

According to the present invention one method by which these problems may be addressed is to, in conjunction with a formed extraction chamber, increase the bottom hole temperature at or above the injector elevation so that it is above the dew point of the injected solvent, such that the solvent will remain as mostly vapour in the hot zone of the chamber and only reach its bubble point at the extraction surface. The higher temperature of the injected solvent provides sensible heat that is used to vapourize condensed or liquid solvent within the chamber, thus reduces the liquid solvent within the chamber that is not being productive. This may reduce the solvent volume used in the Nsolv® condensing solvent process. What is desired is to do so without creating any in situ barriers for draining fluids or for non-condensable gas removal. In this sense, the present invention may provide a heated zone locally around the injector which extends into the extracted portion of the chamber. A heated zone in this sense means that the temperature of the heated zone is above the condensation temperature of the solvent at the extraction interface, to promote vaporization of any liquid solvent passing through the heated zone.

Therefore, according to one aspect the present invention may provide a method of reducing an in situ liquid solvent inventory in a condensing solvent gravity drainage extraction process which includes a pair of generally horizontal wells, including an upper injection well and a lower production well, the method comprising the steps of:

growing an extraction chamber around said generally horizontal well pair by injecting a solvent vapour from said upper injection well under conditions which cause at least a portion of said solvent vapour to condense on a hydrocarbon extraction interface at a condensation temperature, which condensation temperature is above naturally occurring formation temperature whereby in situ hydrocarbons are mobilized at said extraction interface through solvent and thermal effects, accumulating within said extraction chamber condensed liquid solvent which is draining through the chamber under the influence of gravity, which liquid solvent includes a hydrocarbon rich fluid production stream which is proximal to said extraction interface and comprises liquid solvent and mobile hydrocarbons and a hydrocarbon lean production stream which is remote from said extraction interface, and comprises primarily liquid solvent, and heating an extracted volume of said chamber around said injection well to a temperature above said condensation temperature to permit said hydrocarbon lean liquid solvent stream passing therethrough to re-vapourize, without the elevated temperature zone completely extending into the cooler drainage zone adjacent to said extraction interface or extending to said production well, containing said hydrocarbon rich production stream.

The application of the temperature increase to the extracted volume may be beneficial after the extraction chamber has grown enough that it has reached top of pay when the heat losses to the overburden are much higher than a young chamber. At this time, the draining liquids above the heated zone will be hydrocarbon lean. If the increased injector bottom hole temperature is applied too early or is set too high, when the chamber is too small, the drainage fluids may be affected by the elevated temperature. This may cause the dissolved solvent and non-condensables in the drainage fluids to vapourize from the drainage fluid, rendering the heavy oil in the drainage fluid relatively immobile at certain conditions thereby creating a drainage barrier as was postulated in conjunction with the Thermal Solvent process described above. The present invention comprehends a balance between increasing the heat deposited to the extracted volume and simply increasing the amount of solvent being injected to satisfy the growing demand for solvent in a growing chamber with an expanding extraction surface.

In another aspect, the present invention may limit or not apply an increase in temperature to the extracted volume until there is sufficient extracted volume adjacent to the heated zone to permit mixed fluids (solvent and hydrocarbons being recovered) to drain to the production well without passing through the heated zone and therefore without flashing off the solvent.

In another aspect, the present invention may place additional heaters above the elevation of the injector to create a larger solvent liquid depleted zone, provided that it adheres to the same principles of injector heating and the hot zone does not significantly overlap with the overburden to cause excessive heat loss to the overburden.

The present invention comprehends the bottom hole temperature of the extracted zone may be increased by a variety of methods, separate or in combination, for example, but not limited to:

- Elevating solvent temperature but not pressure (superheated injection)
- Re-injecting a heated, solvent-rich well casing gas
- Adding a bottom hole electric heater, hot tubing containing a circulating heat transfer fluid, or any other heat generating device to the injector
- Co-injecting a vapour energy carrier, for example steam, that may preferentially condense near the injection well bore to create a local heat effect.
- Co-injecting a vapour energy carrier that additionally solubilizes asphaltenes deposited in the already extracted zone, for example dimethyl ether, other light ethers, aromatics, and the like that may preferentially condense prior to the extraction interface to beneficially heat the working solvent.

In some cases, the central process facility may be located a significant distance from the individual well pads, which may lead to appreciable heat losses to superheated solvent or other heated injection fluids before it can reach the injector bottom hole. Therefore, the present invention may also contemplate vapourizing and/or heating the solvent or other heating injection fluids at the well pad, rather than solely at the central process facility to achieve the bottom hole temperature target. Heating at the well pad may provide cost efficiencies for injecting larger volumes of vapour due to superheat. Furthermore, bottom hole electric heaters or hot tubing containing a circulating heat transfer fluid may be employed to similar effect. Hot tube surfaces primarily relying on conductive heat transfer tend to deliver a lower heat intensity per unit length, due to the relatively low heat transfer coefficient to a convective gas, therefore it may be necessary to equip the tubes with heat transfer enhancing fins or to deploy the tubes directly into the sand matrix.

The present invention may also contemplate various methods as known by those skilled in the art to prevent excessive heat loss from the intermediate sections of the injector. These may include but are not limited to;

- Packing-off the injector intermediate casing from the horizontal section
- Filling the intermediate casing with an insulating media
- Deploying insulated vacuum tubing
- Establishing a buoyant gas blanket to insulate the injector from the overburden.

The present invention may also contemplate using various measurements such as real time monitoring of the temperature contours of the extraction chamber by observation well temperatures, tracking solvent to oil ratio changes, tracking solvent retention changes, well temperature tracking and long term analysis such as seismic analysis. Some or all of these measurements may be used to assist in establishing an appropriate hot zone adjacent to the injection well.

According to another aspect the present invention may also provide a method of reducing a solvent to oil ratio in a condensing solvent extraction process comprising the steps of:

- establishing an extraction chamber around a horizontal well pair within a pay zone in an underground hydrocarbon bearing formation, the extraction chamber including drainage layers of mixed solvent and hydrocarbon fluids adjacent to an extraction interface;
- supplying heat to an extracted area of said chamber around said injection well to form a hot zone to vapourize at least some liquid solvent within said hot zone, and
- restricting a reach of said supplied heat to prevent said hot zone from completely extending to said drainage layers.

BRIEF DESCRIPTION OF THE DRAWINGS

Reference will now be made by way of example only to preferred embodiments of the invention by reference to the following drawing in which.

DETAILED DESCRIPTION OF THE PREFERRED EMBODIMENTS

Figure 1:
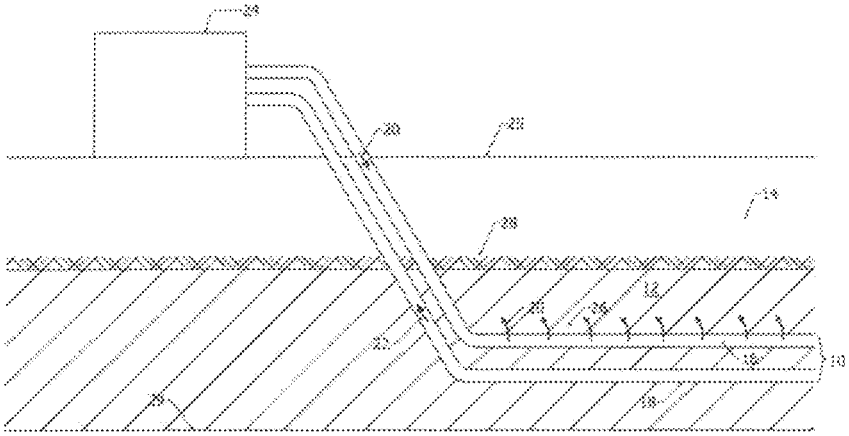
FIG. 1 shows side view of a horizontal well pair located in a pay zone in an underground formation according to the present invention.

As shown in FIG. 1, the underground facilities may consist of one or more horizontal well pairs 10 located in a pay zone 12 of an underground formation 14, with the upper well 16 of the well pair being an injector well and the lower well 18 being a production well. A condensing solvent 20 is placed into the formation 14 through the injection well 16. Although many solvents 20 are comprehended by the present invention, butane may be used as an example for the solvent, since it has a reasonable condensing temperature at a reasonable pressure for a shallow, but not untypical pay zone in the Alberta oil sands, such as the MacKay River deposit. Propane, ethane, pentane, dimethyl ether, H2S, ammonia, COS, other light ethers, light aromatics and the like may also be suitable solvents in some cases. Any solvent that is compatible with the Nsolv® process is suitable for this invention as well. Mixed production fluids 22 are brought up from the production well 18 to a surface plant 24, resting on a surface 25 where the bulk of the water and particulates are separated from the oil and solvent. The solvent 20 is then separated from the oil, purified to a tolerable non-condensable concentration limit for the reservoir, and re-injected into the injection well 16 all as generally described by Nenniger. FIG. 1 is the start of an extraction process where the nascent chamber 26 essentially consists of an extracted zone immediately surrounding the horizontal well pair which permits communication therebetween. The top of the pay zone 12 is defined by an overburden layer 28, and the bottom of the pay zone is defined by an underburden layer 29.

Figure 2:
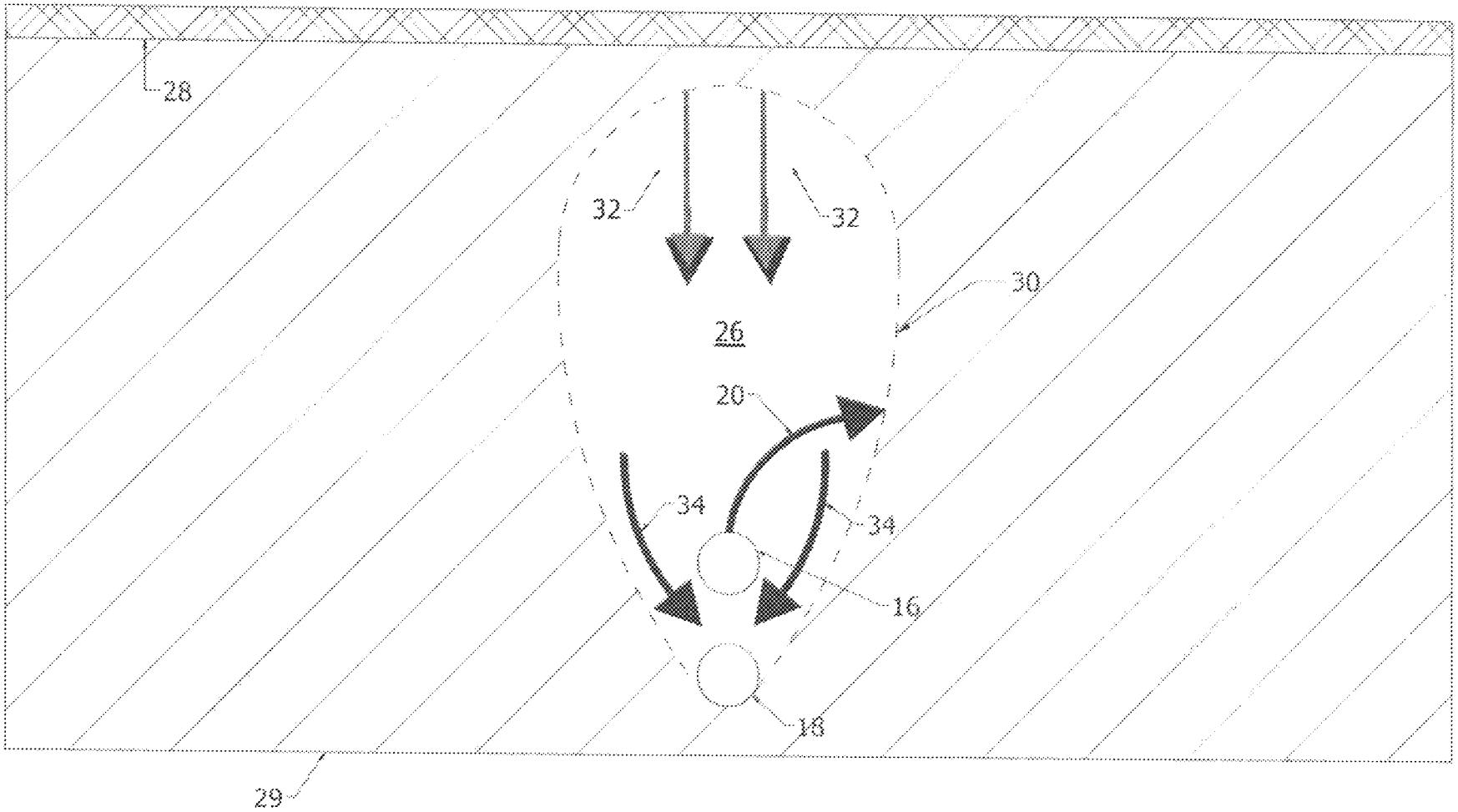
FIG. 2 shows the same well pair, but in cross sectional view showing a growing extraction chamber up towards the overburden layer according to the present invention.

FIG. 2 is the same underground formation as in FIG. 1 but in cross section instead of a side view. Further a certain amount of time has elapsed and the chamber 26 has grown. In FIG. 2 the chamber boundary is shown at 30. As will be understood by those skilled in the art the chamber boundary is defined by the extraction interface. Condensation of the solvent 20 on the surface 30 delivers both solvent and thermal effects to the immobile bitumen, thereby mobilizing the same. It can be seen by the arrows 32 that some of the mixed fluids drain down from above to flow past the injection well 16 to get to the production well and some of the mixed fluids drain along the side of the chamber at 34 and do not pass very close to the injection well.

Figure 3:
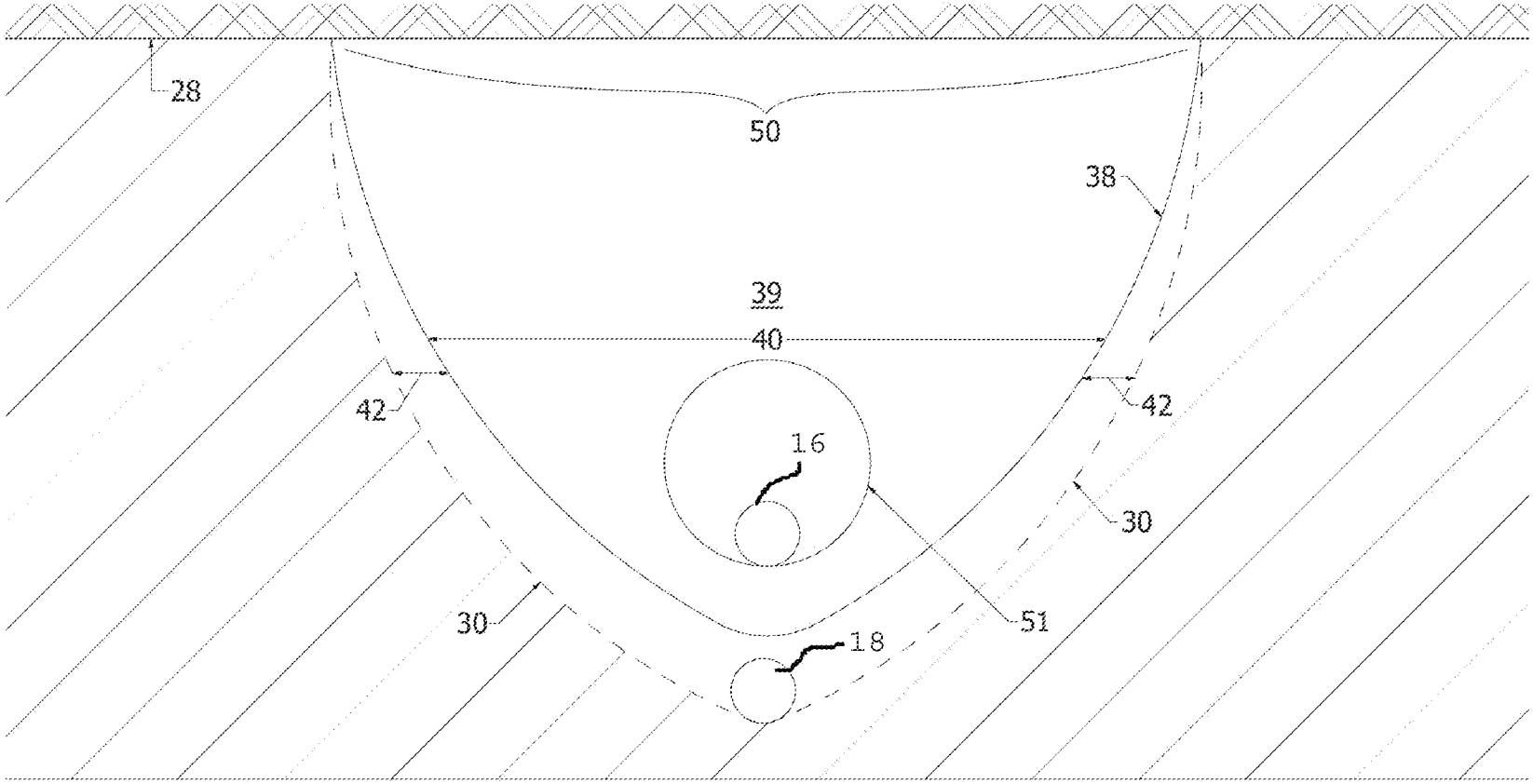
FIG. 3 shows the same cross section as in FIG. 2 with the extraction chamber being even more mature with an area of the extracted reservoir adjacent to the injection well being raised in temperature as a hot zone according to the present invention.

FIG. 3 is the same view as FIGS. 1 and 2, but with the chamber much more well developed. As can be seen, the chamber 39 has expanded up to and along the over burden layer 28 and the swept zone extends above and out to both sides of the injection well. In FIG. 3 there are two drainage zones divided by the imaginary demarcation line 38. In the drainage zone 40, there is mostly solvent and very little hydrocarbon, whereas in the drainage zone 42 there is mostly combined solvent and hydrocarbon. Drainage zone 40 depicted in FIG. 3 represents one or more hydrocarbon lean production layers in the extraction chamber 39. Similarly, drainage zone 42 depicted in FIG. 3 represents one or more hydrocarbon rich fluid production layers in the extraction chamber 39. Although this is depicted with a line 38, it will be appreciated by those skilled in the art that local variations are possible and so the boundary between one and the other is not likely to be so sharp, but more like a gradual changing of the gradations of higher concentrations of liquid solvent to lower concentrations of liquid solvent the closer to the extraction surface 30 within the chamber. What can be seen is that solvent rising above the injection well to the overburden layer 28 that contacts the area identified by bracket 50 will have little beneficial effect on further bitumen extraction because substantially all of the bitumen has already been swept out of the zone 40 that it is passing through.

FIG. 3 also shows that an area of the extracted zone 40 within the chamber 39 has been heated as shown at 51. This might be heated by super heat, an in-line heater in the injector well energized electrically or by internally circulating heat transfer fluid, or by means of a limited amount of co-injected steam. The present invention comprehends other means to achieve the same local heating effect, such as induction or electromagnetic heating, radio-frequency heating, microwave heating or the like. However, because some of these are more expensive at present these may be considered less preferable approaches.

Certain aspects of the present invention may be illustrated by way of example. A demonstration plant for the Nsolv® extraction process has been operating near Fort McMurray, Alberta, for several years and various qualities have been measured over that time. In this demonstration plant it was found that the solvent inventory in the reservoir at any given degree of extraction could be estimated by a volumetric balance, which is the total solvent make-up injected minus facility losses, and could be reported as a ratio to the volume of product oil. Both daily and cumulative inventory ratios could be tracked. This inventory of solvent may represent a combination of solvent in the drainage layer that has not yet been produced to surface, uncondensed solvent vapour, and solvent that has condensed in the swept zone away from the drainage layer so that it is not extracting oil. Such solvent may be thought of as short circuiting in the chamber. In other cases non-conformities may be present which impede drainage and can cause liquid pools of solvent to accumulate thereby contributing to solvent retention.

Another metric that could be tracked at the demonstration plant is the solvent to oil ratio (SvOR), which may be calculated as the volume of injected solvent divided by the volume of produced oil. As with the solvent inventory, daily and cumulative ratios could be tracked.

A large inventory of solvent in the reservoir is undesirable because it increases the make-up solvent requirements (operating costs) and may require a longer solvent recovery period during chamber blowdown. A large inventory of solvent, particularly due to solvent short-circuiting, contributes to increasing the SvOR. This solvent is condensing away from the solvent-oil interface and in some cases may be accumulating in the reservoir instead of being produced to surface. The demonstration plant has found that the change in daily solvent inventory ratio generally follows in trend to the change in daily SvOR.

Figure 4:
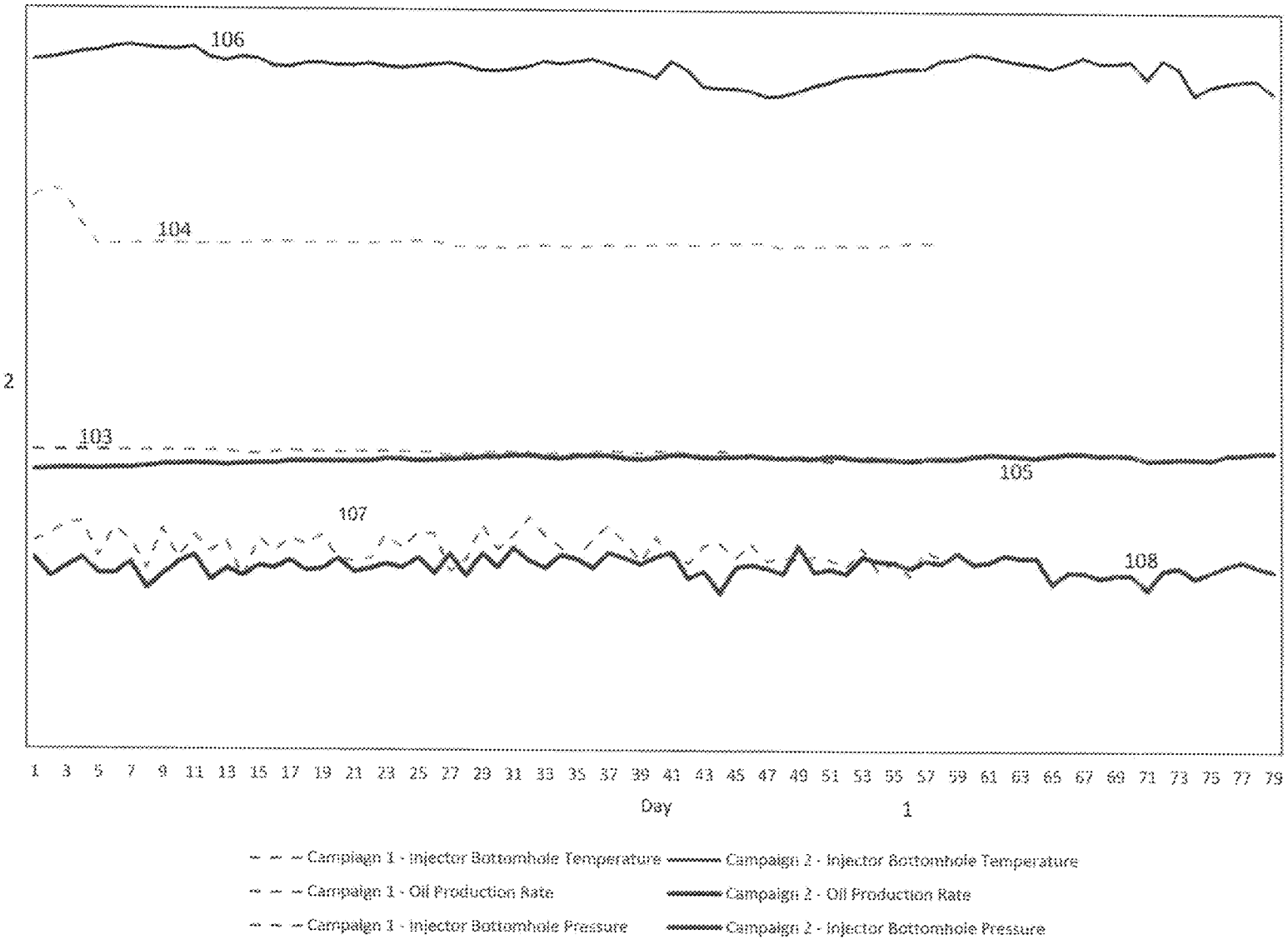
FIG. 4 compares the operation of the demonstration plant at two different injector bottom hole temperatures FIG. 5 compares the calculated metrics during the two temperatures of FIG. 4.

FIG. 4 compares the operation of the demonstration plant at two different injector bottom hole temperatures to raise the temperature in zone 51 from FIG. 3 to two different temperatures for comparison purposes. The horizontal axis (1) represents days of stable, continuous operation, while the vertical axis (2) illustrates the magnitude of each measured metric, which is represented by the various lines on FIG. 4. Operating at the first temperature shows data for 58 days, while operating at the second temperature has data for 79 days of stable, continuous operation. With the first temperature, the solvent was injected such that the injector pressure was about 600 kPag (103) and the average injector bottom hole temperature was approximately constant at 63° C. (104), which is just above the bubble point of the solvent at 600 kPag. During the second campaign, the solvent was injected such that the injector pressure is maintained at 600 kPag (105), but that the average injector bottom hole temperature was raised to about 83° C. (106). The oil production rate during the first (107) and second (108) campaigns are very similar.

Figure 5:
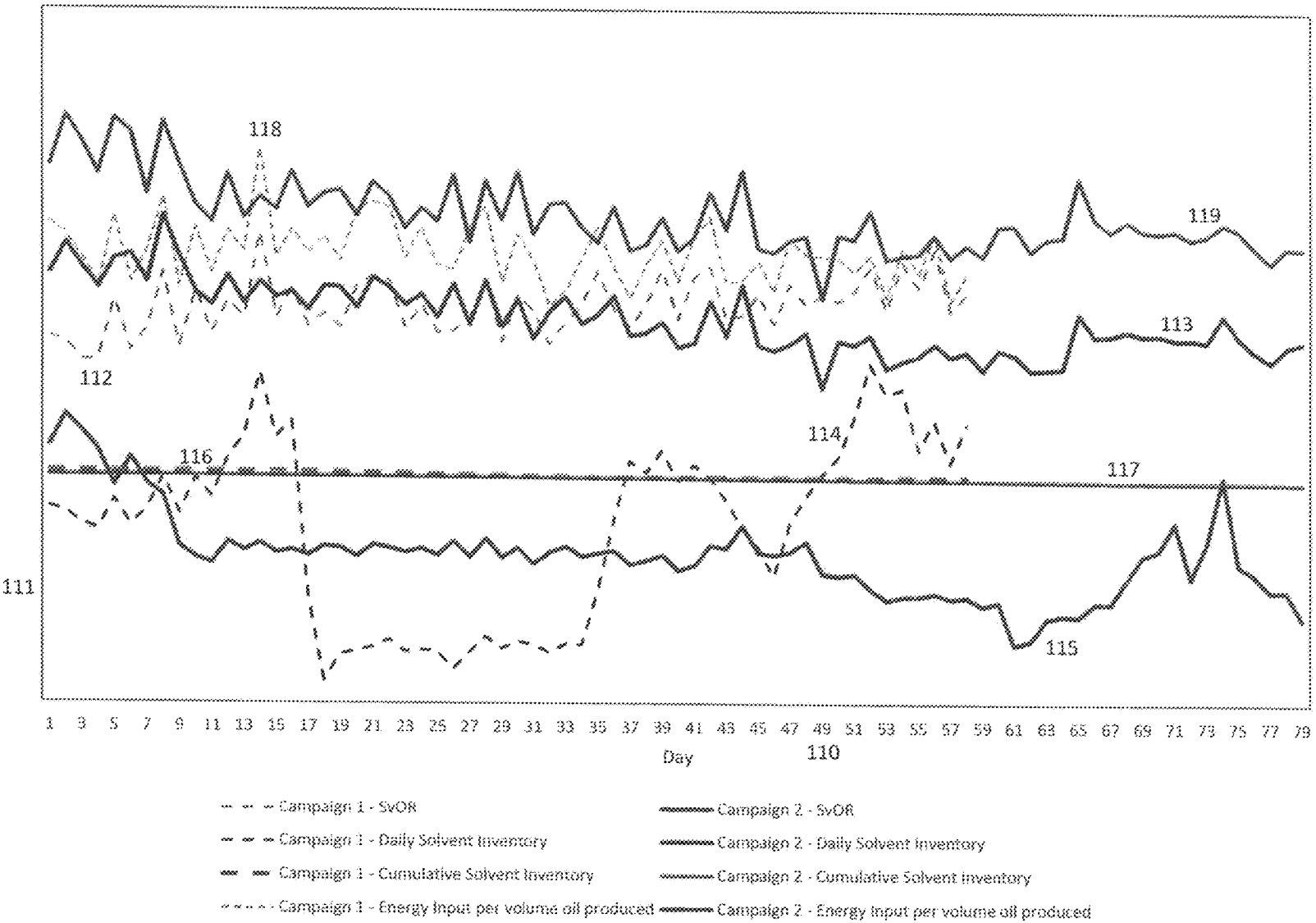

FIG. 5 compares the calculated metrics while operating at the two different temperatures for a mature chamber of the type shown in FIG. 3. The horizontal axis (110) represents days of continuous operation, while the vertical axis (111) illustrates the magnitude of each calculated metric, which is represented by the various lines on the figure. The daily SvOR at the first temperature (112) shows a general trend upward, while the daily SvOR at the second temperature (113) shows a general trend downward. The daily solvent inventory for the first temperature (114) shows a fair amount of fluctuation, but with a general trend upwards, while at the second temperature (115) shows a steady downward trend of the estimated daily solvent inventory. These trends in solvent inventory are also illustrated by the comparing the cumulative solvent inventory, line 116 for the first temperature and line 117 for the second temperature. FIG. 5 also compares the energy intensity of the two temperatures, that is, the energy input to pump and heat the injected solvent per volume of oil produced. The energy input for the second temperature (119) is higher than for the first temperature (118) initially, but by the end of the runs is almost at the same level. It is believed that if the second temperature were run for longer, the energy input levels would be approximately the same as the first temperature because the size and thus heat capacity of the chamber is approximately the same during the two campaigns that were run back to back.

Overall, using the first temperature conditions as the baseline, the results of the two tests showed that while the produced oil rate was approximately the same and energy applied per volume of oil produced did not increase significantly, the daily solvent inventory decreased by nearly 70%, while the daily SvOR decreased about 10%. Without being restricted to a specific mechanism, the decrease in solvent inventory may be due to the extra sensible heat of the injected solvent, which reduces solvent short-circuiting, and possible vaporization of liquid solvent that previously condensed in the swept region away from the drainage layer, allowing the solvent to now move laterally to the drainage layer where it may condense, drain and be produced to surface. In other words, the extracted zone may include more vapour than without the increased temperature zone and the extraction surface may include more liquid solvent. To ensure the bottom hole pressure does not increase, the operation is thus required to reduce the amount of solvent injected into the reservoir.

In this example, the injector bottom hole temperature increase from 63° C. to 83° C. was achieved by superheating the solvent. This temperature increase was by way of example only and is not intended to be limiting. The bottom hole temperature of the extraction zone may be heated between the dew point of the injected solvent up to for example 250° C., which is a practical operating temperature constraint for some surveillance instrumentation employed in the injector well, although the optimum temperature profile will be determined based on establishing an appropriate reach of the hot zone adjacent to the injection well. While higher temperatures extend the reach of the liquid solvent depleted hot zone, it can lower the solvent concentration in the produced fluid such that there is insufficient solvent to maintain fluid mobility and/or remove the non-condensable solution gas from the reservoir. The removal of non-condensables from the chamber by solvent in the produced fluids has been previously taught by Nenniger to avoid the adverse effects non-condensable gases have on solvent-bitumen interface. The higher the operating temperature the greater the energy required and so the more greenhouse gasses will be produced. Thus, while the higher temperatures noted above are comprehended, lower temperatures are generally preferred. The present invention may deliver reasonable results across a wide range of temperatures depending upon in situ characteristics and the maturity of the extraction chamber. The present invention is also not limited to increasing the injector bottom hole temperature by superheating the injected solvent. The same effect may be achieved using other methods to deliver heat to the extracted portion of the chamber, including downhole electrical resistance heaters as will be understood by those skilled in the art. Downhole heaters may offer the advantage of more uniform heat distribution across the entire length of a horizontal well (and chamber). What matters is that the injector bottom hole temperature is increased such that the SvOR and solvent inventory in the extracted region may decrease, without affecting the oil production rate or significantly increasing the energy consumption.

Vapour short-circuiting from the injector directly to the producer is anticipated and may even be exacerbated by increasing the bottom hole injector temperature, therefore, the present invention may also contemplate various methods to prevent or limit the amount of vapour short-circuiting to the producer, including, but not limited to:

- Submerging the producer with sufficient liquid solvent by managing pressure drawdown on the producer
- Inflow control devices
- Outflow control devices
- Blanking-off offending sections of the well identified through well surveillance techniques.

The present invention increases the temperature in the region near the injector well rather than in or near the producer. This permits continued drainage of the drainage layer with concomitant non-condensable gas removal through the production well. This may be illustrated by the following example.

Consider a volume of reservoir in the Athabasca oil sands of Alberta with a porosity of 30% and oil saturation of 80% and native reservoir temperature of 10° C. The sand has the same properties as silica sand, that is a density of 2700 kg/m$^3$ and specific heat of 830 J/kg° C., the oil has a density of 1030 kg/m$^3$ and specific heat of 1023 J/kg° C., and the water has a density of 1000 kg/m$^3$ and specific heat of 4186 J/kg° C. Due to the high volume of sand, the sand fraction accounts for over 75% of the total heat capacity of the reservoir even though the specific heat of oil and water are higher than the sand. This means that over 75% of the heat delivered to the reservoir will be used to raise the temperature of the sand from native reservoir temperature.

Now, consider that the reservoir has an injector well placed some distance below the top of the pay zone, with a producer well placed some distance below the injector, typically between 3 and 5 meters although this can vary. Consider the circumstance of FIG. 1 where the reservoir has been heated and possibly injected with a fluid to establish fluid communication between the injector and producer wells in preparation for condensing solvent EOR such as the Nsolv® process. After communication is established, a volume of the oil and water between the injector and producer may have been displaced or extracted from the reservoir, as shown at 26, but the formation sand remains in place and thus can continue to absorb heat. In the extracted portion of the chamber, the sand will account for a higher percentage of the total heat capacity in the reservoir because of the removal of oil and water from around the sand grains. While the temperature driving force between the incoming solvent vapor and sand will decrease as the sand heats up, because of its large mass and the fact that specific heat increases with temperature, the extracted sand matrix will remain a significant sink for heat brought into the reservoir by means of, for example, the injector. In other words, the hot zone created around the injection well can be controlled as to size and reach due to the slow heating of the sand grains by the proposed methods since the sand matrix is a significant heat sink in addition to the vapourization of hydrocarbon lean liquid that is present or draining into the hot zone.

Figure 6:
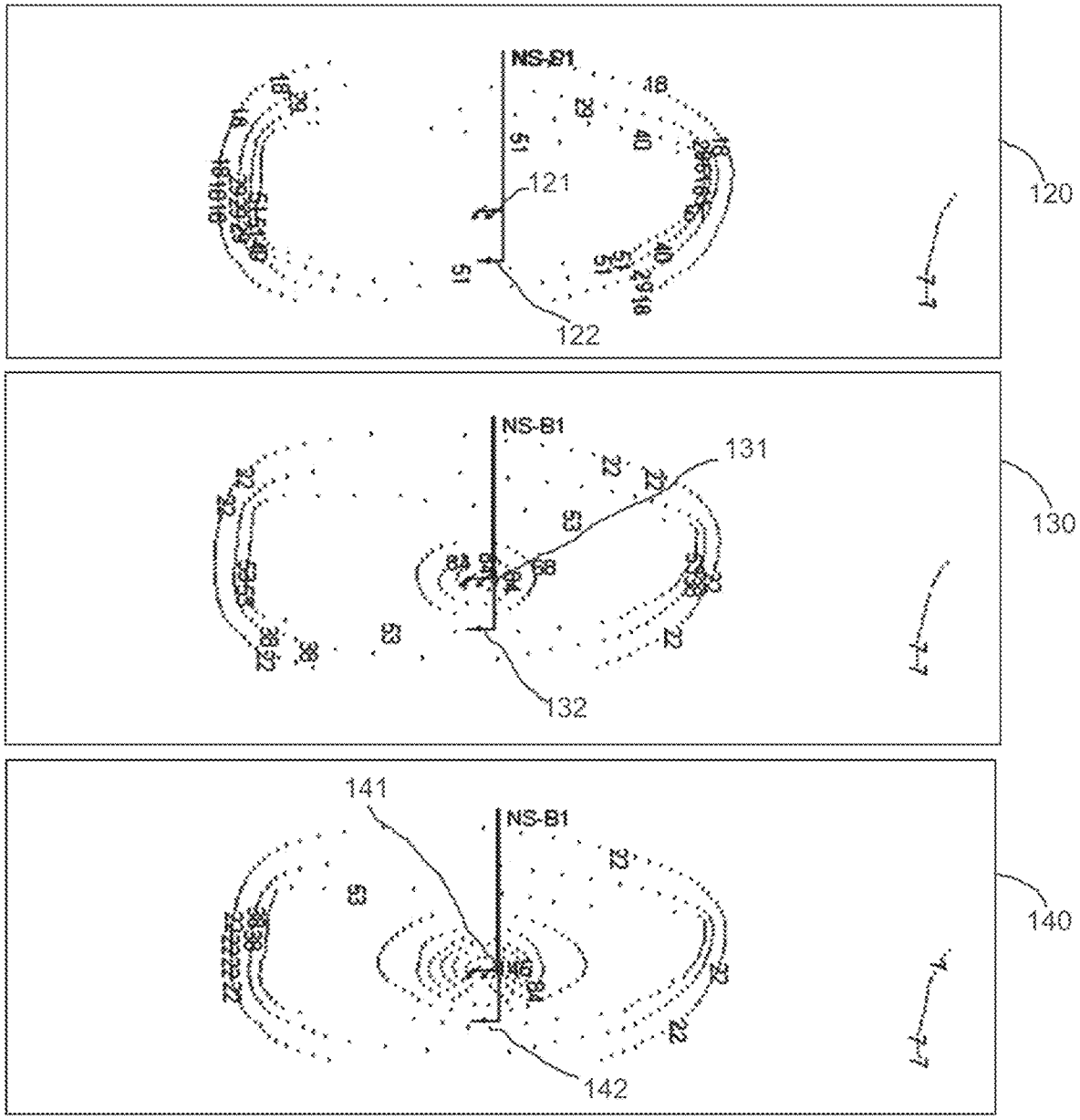
FIG. 6 shows the estimated the reservoir temperature profiles after 3.5 years of oil production by a condensing solvent process.

FIG. 6 shows one estimate of the reservoir temperature profiles or contours after 3.5 years of oil production by a condensing solvent process such as the Nsolv® condensing solvent process. The same injector bottom hole pressure has been applied to each profile, but a different injector bottom hole temperature was used from the start of production through the 3.5 year production phase. The temperature profiles have been estimated by 2D energy balance using computational modeling software CMG STARS. On the first profile (120), the injector is indicated by 121 and has a bottom hole temperature of 63° C. The producer (122) is between 38° C. to 53° C. On the second profile (130), the injector (131) has a bottom hole temperature of 110° C. and the producer (132) is between 38° C. to 53° C. On the third profile (140), the injector (141) has a bottom hole temperature of 160° C. and the producer (142) is between 53° C. to 68° C.

Note that for all three profiles, the temperature increases radially around the injector but the temperature along the drainage layers 42 (FIG. 3) are mostly unaffected. This is because of the large mass of sand in the reservoir and heat of vapourization of hydrocarbon lean drainage fluids represent large heat loads in the reservoir. In the 3$^{rd}$ profile (140), where the injector is at the highest temperature, the region near the producer well (142) may be approaching the bubble point of the mixed draining fluids in the drainage layer, therefore it may be necessary to reduce the temperature of the injector for continued operation to avoid adversely affecting the drainage layer production. In other words, the increased temperature in the extracted portion of the chamber cannot be allowed to extend all the way to the mixed draining fluids without running the risks that the problems identified with respect to the CA 2,281,276 will begin to appear.

Figure 7:
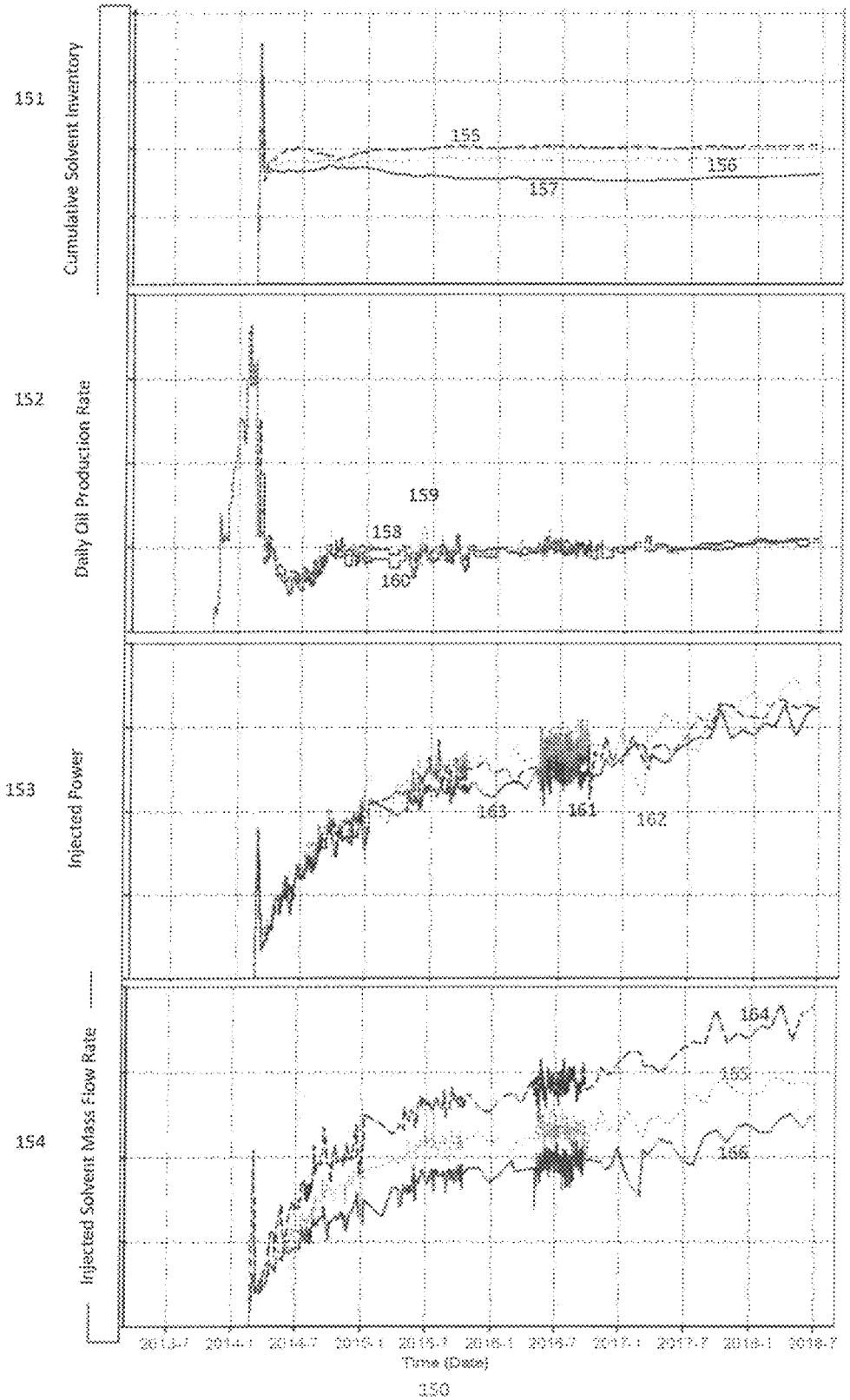
FIG. 7 compares the production results for the three different injector bottom hole temperatures for the duration of the production described in FIG. 6.

FIG. 7 compares the production results for the three different injector bottom hole temperatures described in FIG. 6. The x-axis (150) represents time, while the y-axis represents Cumulative Solvent Inventory (151), Daily Oil Production Rate (152), Injected Power (153) and Injected Solvent Mass Flow Rate (154), which is approximately proportional to SvOR when oil production is similar between cases. The heavy dashed lines represent operation with 63° C. injector bottom hole temperature (155, 158, 161, 164), the thin dashed lines represent operation with 110 C injector bottom hole temperature (156, 159, 162, 165) and the solid lines represent operation with 160 C temperature (157, 160, 163, 166). While the oil production rate (158, 159, 160) and injected power (161, 162, 163) is about the same for all three sets of data, the cumulative solvent inventory (155, 156, 157) and mass of injected solvent (164, 165, 166) is lowest for the higher injector bottom hole temperature (157, 166).

Without being restricted by the temperature ranges given in the above examples, it can now be understood that increasing the injector bottom hole temperature such that it does not have a significant effect on the drainage layer temperature, can reduce the solvent inventory and the solvent to oil ratio. The injector bottom hole temperature increase may be applied at a mid-point in the well life or it even may be applied at the start of production as long as there is a drainage path that is unaffected. The injector bottom hole temperature increase may be achieved by superheating the injected solvent, co-injecting with steam, and/or by a downhole heater or other means of supplying heat. The optimum injector bottom hole temperature set point(s) for a particular reservoir will depend on the reservoir properties and well design, and will be a trade-off between its impact on equipment size and cost, and the effect on the drainage layer, while maintaining condensing conditions at the solvent-oil interface, namely the bubble point temperature corresponding to the bottom hole pressure and preventing accumulation of non-condensable gas in the chamber by solvent concentration, as taught in prior art. As non-condensable gases accumulate within the chamber and at the interface the bubble point temperature of the solvent gas mixture is depressed, which in turn lowers the extraction temperature and creates resistance for solvent condensation mass transfer. With these considerations, the maximum injector bottom hole temperature can be calculated for the estimated minimum solvent to oil ratio required to extract oil, as taught by Nenniger. The maximum injector bottom hole temperature temperature and its effect on the drainage layer may be determined by computational modeling during the design phase of the wells and/or by estimating the extent of bubble point depression in comparison to sand pack and filed trial reference values and/or may be monitored during operation by observation well readings, the producer temperature readings, and by chamber classification through seismic analysis.

As the wells are depleted of extractable oil, it may be necessary to gradually decrease the elevation of injector bottom hole temperature to transition the chamber from the production phase to wind-down phase and eventually blowdown phase to recover solvent. Reducing the injector bottom hole temperature at the right time may be important to avoid leaving excessive energy stored in the reservoir once it has been depleted of solvent.

Figure 8A:
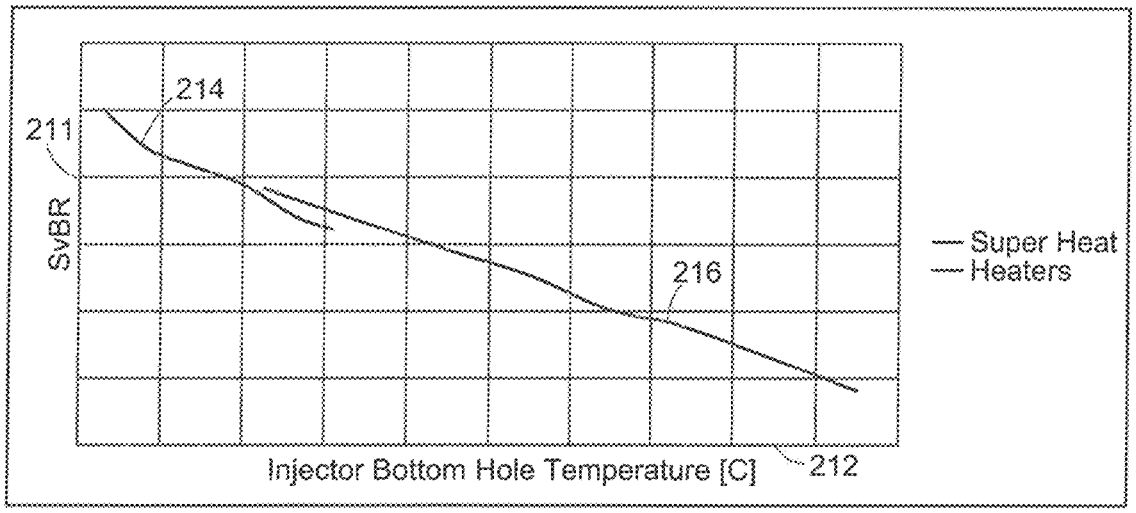
FIG. 8*a* shows the effect that injector bottom hole temperature has on SvOR using either injected superheated solvent or bottom hole electric heaters.
Figure 8B:
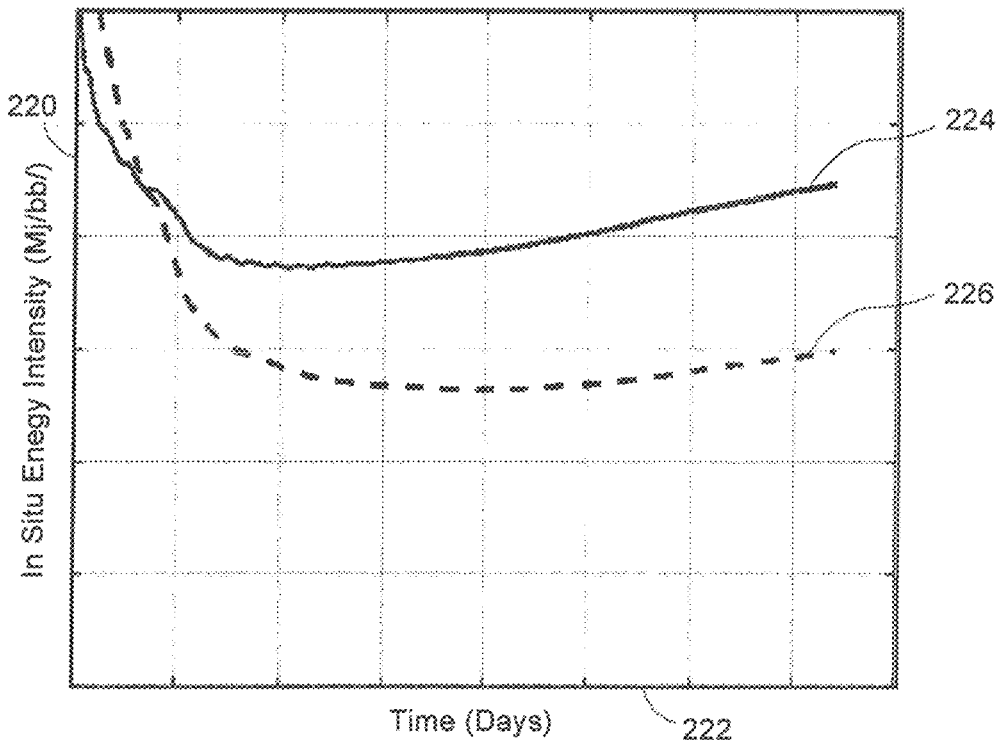
FIG. 8*b* compares in-situ energy intensity of injected superheated solvent and bottom hole electric heaters for the same bottom hole temperature.

The present invention comprehends that while increasing the temperature of the injector bottom hole above solvent saturation may not significantly impact the oil production rate for the same bottom hole pressure, the means of supplying that extra heat may impact the overall solvent usage and thus the SvOR and solvent inventory. FIG. 8(*a*) is a plot of the SvOR required for different injector bottom hole temperatures as calculated by mass and energy balance using computational software CMG STARS. The SvOR 211 is on the y-axis, while injector bottom hole temperature 212 is on the x-axis. Line 214 represents the SvOR when injector bottom hole heating is achieved by superheating the injected solvent, while Line 216 represents the SvOR when heating is achieved by electric resistance heaters placed downhole. These electric heaters may be dedicated to increasing the injector bottom hole temperature during oil extraction and may be installed after a period of solvent vapour injection into the underground formation, where the extraction chamber has grown, for example towards the overburden. Alternatively, these heaters may be installed with the injector well and may be the same heaters used for preheating the near wellbore region of the injector and helping to establish fluid communication between the injector and producer wells. The oil production profile corresponding to lines 214 and 216 are very similar as was shown in the previous example. Using electric heaters may not significantly change the SvOR than superheated solvent for the same injector bottom hole temperature and pressure since it is the bottom hole temperature that governs the driving force of heat transfer into the hot zone extending from the injector and this heats the sand matrix and vaporizes liquid solvent remaining inside or entering the hot zone.

There may also be a difference in the in situ energy intensity between heating methods. In situ energy intensity is the energy delivered to the reservoir to produce a barrel of oil and includes the enthalpy and/or electrical energy of the heating medium. FIG. 8(*b*) shows the in situ energy intensity plotted on the y-axis 220, plotted against time on the x-axis 222 with line 224 representing energy intensity when using superheated solvent and line 226 representing energy intensity when using electrical heating to maintain approximately the same injector bottom hole temperature and oil production. The superheated solvent 224 requires more energy per bbl of oil than the electric heaters because the solvent is prone to heat losses in the well incline, thus it may need to be superheated above the targeted injector bottom hole temperature to overcome those heat losses. For the well incline heat losses estimated for the Nsolv® demonstration plant operated near Fort McMurray Alberta, the solvent may need to be heated to approximately 250° C. at the wellpad to have 150° C. in the injector bottom hole. In addition, electrical resistance heating is typically more energy efficient than thermal resistance heating (excluding power generation, transmission and transforming losses) as every kilowatt of electric heat is converted to thermal heat at a ratio of 1:1 and it can be applied directly to the injector bottom hole, while there may be additional heat losses and inefficiencies with heating the solvent in the surface in preparation for injection. There may however, be limitations to the heat that can be provided by electric heaters or the like, namely the maximum power available per heater and the number of heaters that may be practical to place in the injector due to physical space and cost constraints.

A combination of heating methods may also be utilized. For example, electric heating may be the predominant source initially, adding solvent superheating later as the chamber grows and the solvent to oil ratio increases. Vice versa, solvent superheating may be utilized initially, supplementing electrical heating later to offset the increase in SvOR as the chamber grows. The method and combination of heating may be a trade-off between equipment size, cost, and energy efficiency, as long as there is sufficient solvent injected in situ to achieve condensing conditions at the solvent-oil interface, including withdrawal of non-condensable gases.

The present invention may also be used in conjunction with other methods that help to retain heat in the extracted chamber, such as establishing a buoyant gas blanket of non-condensable gases to prevent heat loss from the chamber to the overburden, as taught by Nenniger. This may reduce SvOR and/or solvent inventory by reducing the heat loss to the overburden, the amount short circuit solvent condensation required to service said heat loss, and the amount of liquid solvent draining through the extracted zone.

When solvent is injected dry then it may pick up a small amount moisture from the formation water up to the water saturation limit of the solvent gas. This in turn may slowly dessicate the region of the chamber that extends from the injector. Under elevated bottom hole conditions, the solvent gas will have a higher propensity to evaporate water in the hot zone. This water is expected to partially condense towards the edge of the hot zone, somewhat analogous to the steam co-injection system. Under certain conditions this may dessicate a portion of the sand matrix to the extent that, when cooled, this dessicated region may no longer behave as a water-wet sand system, and it may have somewhat reduced permeability to hydrocarbon liquids. This potentially negative effect on recovery performance may be avoided by ensuring the gas is injected under water saturated conditions.

In another embodiment of the present invention, the injector bottom hole temperature may be increased by co-injection of a vapour energy carrier with the solvent. The ideal energy carrier should be less volatile than the solvent so that it may condense and release its latent heat to the reservoir before the solvent. It would be most beneficial if the energy carrier had a higher specific enthalpy (i.e. kJ/kg) than the solvent so that it can deliver more energy to the formation per unit mass than the solvent. Finally, it should also be less expensive than solvent to inject in situ since it may serve to reduce the solvent inventory. Steam is a promising energy carrier because it has a higher specific heat capacity and specific latent heat of condensation than many of the solvents envisioned for a condensing solvent EOR, such as propane, butane and the like. Steam co-injection may also prevent the aforementioned potentially negative effect of dessication of sand regions extending from the injection well.

Figure 9:
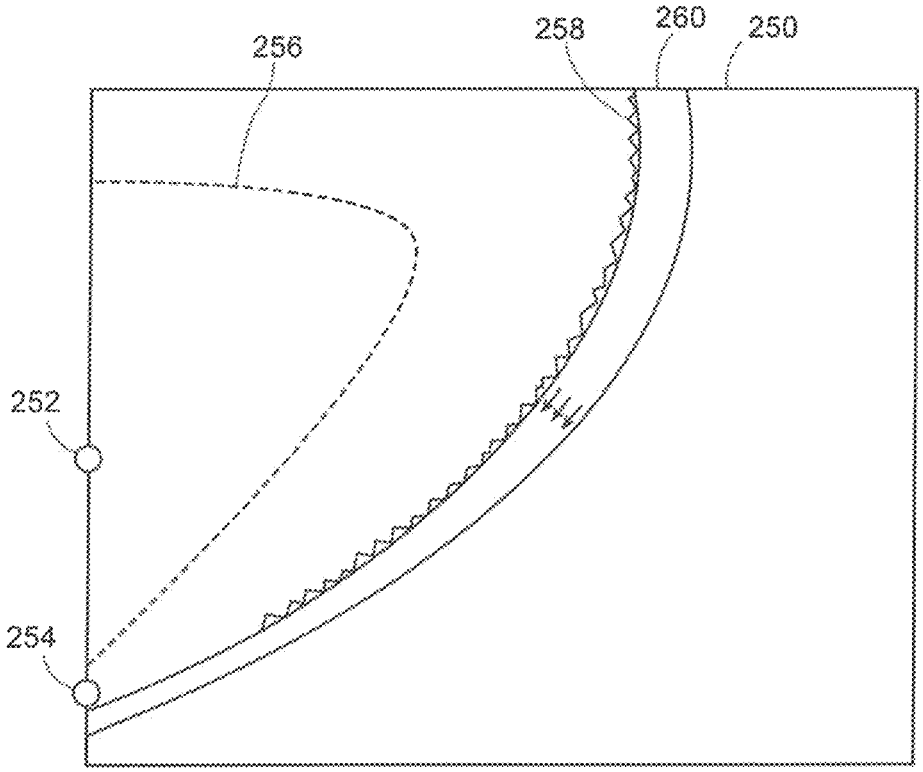
FIG. 9 shows a cross sectional view of a solvent chamber operating with steam co-injection, showing an inner and outer chamber according to the present invention.

FIG. 9 shows a quarter-section of a formation 250 that has been injected for a period of time with a vapour containing 80% butane (solvent) and 20% steam (energy carrier) through the injector well 252. The vapour maintains the elevated injector bottom hole temperature after the wells have established fluid communication by a method that will be known to those skilled in the art. Two vapour chambers may be formed extending approximately radially from the injector 252. There is the steam-solvent chamber bounded by the injector 252 and contour 256 where the temperature is greater than the saturation temperature for solvent. When the temperature drops to the saturation temperature of steam in the gas mixture, steam begins to condense and the temperature profile follows a declining steam saturation temperature profile. Progressive steam condensation caused by aforementioned heat losses from/heat sinks in the hot zone leads to declining steam partial pressures and hence steam saturation temperatures. There is the solvent only chamber bounded by contour lines 256 and 258, where the gas phase is mostly depleted of the he energy carrier steam, because water vapour pressure is relatively low at typical solvent saturation temperatures in the Nsolv® process, but is still above the saturation temperature of solvent. Note the contours 256 and 258 are shown as lines for illustrative purposes, though the boundaries between the chambers will be defined by chamber temperature relative to the saturation temperature of the mixed vapour at declining steam concentration and may not be an exact line. Finally, there is the solvent-oil interface with drainage layer 260 which flows by gravity towards the producer well 254.

Some of the condensed water from the injected steam may preferentially occupy pore space that has been vacated by extracted bitumen and connate water. This pore space would otherwise be occupied by condensed solvent. This may reduce the overall solvent inventory in the chambers as well as the SvOR. The amount of energy carrier to inject with the solvent will be limited by a minimum SvOR that is required to achieve condensing conditions at the solvent-bitumen interface, providing sufficient withdrawal of non-condensable solution gas to surface, and there will also be a trade-off between cost of the energy carrier and energy efficiency of the system for each particular reservoir.

A benefit of using steam as the energy carrier is the main source water for steam generation may be the produced connate water from the reservoir. Many reservoirs have mobile water that may be produced to surface with the solvent and oil. This water may be separated from the hydrocarbons by a number of means as will be understood by those skilled in the art and must be treated and disposed of. For 20% steam co-injection into a reservoir containing about 15% mobile water (typical for Athabasca oil sands), the mass and energy balance shows that 80% of the injected steam may be recycled, with the balance as fresh steam make-up taken from a minor fraction of the connate water, which would allow for bleed of connate water impurities such as salt and other minerals and without the need for fresh water consumption by using evaporative technologies for brackish water, such as mechanical vapour recompression evaporation, steam compression distillation, or multiple effect evaporation, or membrane technologies, such as reverse osmosis, where the permeate may be directed to a boiler. As will be understood by those skilled in the art, the selection of technology is dependent on connate water quality, expected production water cut, co-injection steam requirement, injected steam recycle ratio, availability and cost of energy sources, as well as capital and operating cost tradeoffs for project optimization.

Figure 10:
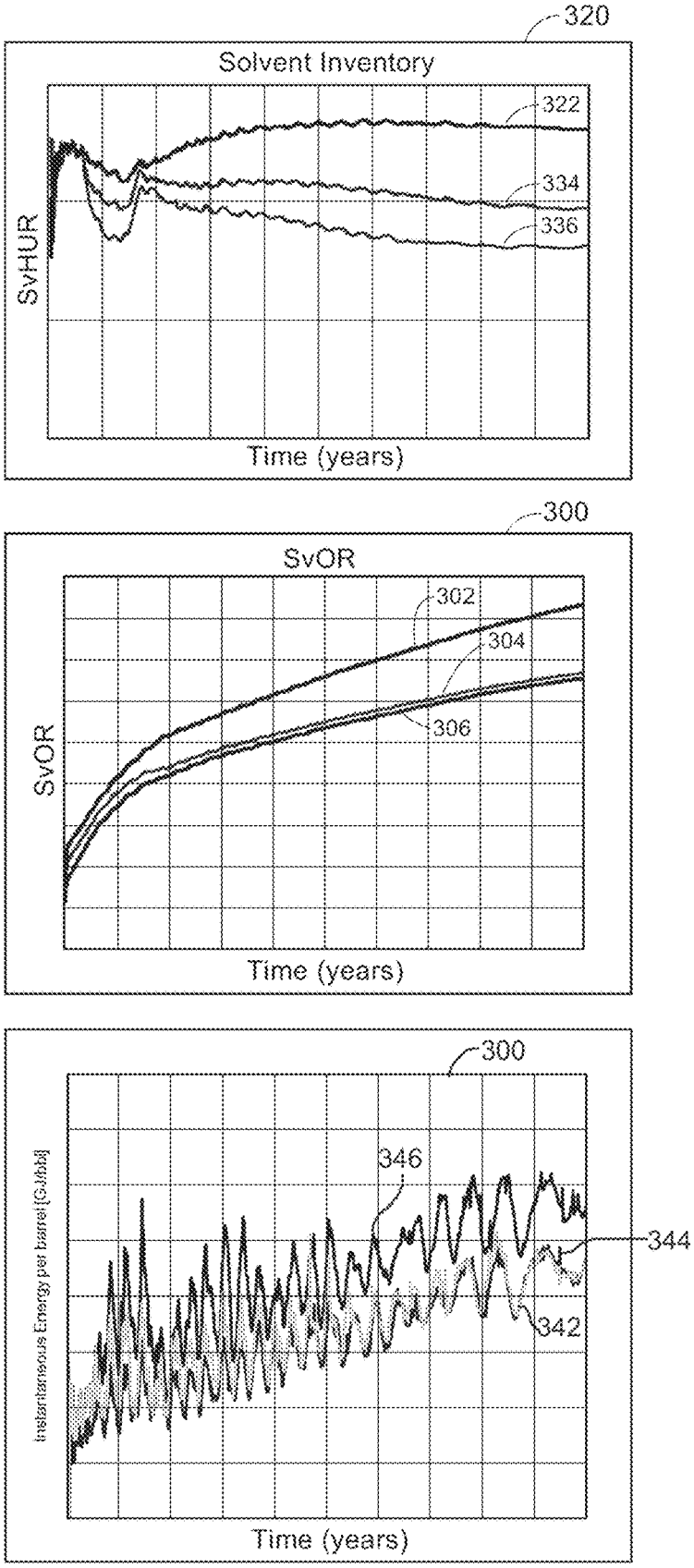
FIG. 10 compares solvent inventory, SvOR, and instantaneous injected energy per barrel of oil production for dew point solvent injection, superheated solvent injection and steam co-injection, all with the same bottom hole pressure.

FIG. 10 shows time profiles for SvOR 300, solvent inventory 320, oil production 330 and energy intensity 340 for a condensing solvent process such as Nsolv®. The profiles have been calculated by mass and energy balance for the same bottom hole pressure, using computational software CMG STARS. Line 302 shows the SvOR profile for a condensing solvent process without increasing the injector bottom hole temperature, which may be considered prior art. Line 304 shows the SvOR profile for one embodiment of the current invention, which is a condensing solvent process that has used superheated solvent to elevate the injector bottom hole temperature. Line 306 shows the SvOR profile for another embodiment of the current invention, that is a condensing solvent process using a limited amount of steam injected with the solvent to elevate the injector bottom hole temperature. For comparison purposes, the injector bottom hole pressure is constant between the three cases presented above. In practice, the injector bottom hole pressure may be adjusted by the vapour injection as the chamber grows to optimize oil production and energy efficiency. The magnitude of the pressure adjustment may depend on the reservoir characteristics, the solvent, energy carrier used, and methods of injector bottom hole heating applied.

Comparing lines 302, 304 and 306 in FIG. 10, the SvOR rises more steeply over time when using prior art (line 302) than when applying the current invention (lines 304 and 306). This is expected because the heat delivered by superheated solvent or steam injection offsets the heat burden on the solvent. Line 322 shows the solvent inventory corresponding to line 302, while lines 324 and 326 show the solvent inventory corresponding to lines 304 and 306 respectively. Line 326 has the lowest cumulative solvent inventory of all the three because condensed steam may have taken the place of solvent in filling the pore space vacated by the extracted oil and connate water.

The in situ energy intensity 340 is shown with line 342 for prior art, line 344 for superheated solvent and line 346 for co-injection with steam. Lines 342 and 344 are very similar while more energy is required for co-injection of solvent with steam line 346. This is due to the higher heat capacity of the water compared to solvent. As the chambers grow, the inventory of water in situ increases, largely off-setting the solvent inventory. Because water has a higher heat capacity than solvent, more energy is required to maintain the water vapour chamber temperature than a solvent chamber. However, if there is a readily available source of steam to the well pad, this may still prove to be an economical way to reduce the SvOR and solvent inventory.

It will now be understood by those skilled in the art that various modifications and alterations can be made to the present invention without departing from the scope of the invention as defined in the appended claims. Some of these have been discussed above. For example, there are a number of ways that the extra heat to create a local hot zone in the extraction chamber to reduce a liquid solvent volume within the chamber can be supplied and the present invention comprehends all such heating methods. Further, while reference has been made to a pair of horizontal wells, the wells could be of any suitable configuration, including one or more horizontal wells, one or more vertical wells or any combination of vertical and horizontal wells.

The invention claimed is:

1. A method of managing a liquid solvent inventory in a condensing solvent gravity drainage extraction chamber which includes at least one injection well and at least one production well the method comprising the steps of:

growing said extraction chamber by injecting a solvent vapour from said injection well under conditions which cause at least a portion of said solvent vapour to condense on a hydrocarbon extraction interface at a condensation temperature, which condensation temperature is above naturally occurring formation temperature whereby in situ hydrocarbons are mobilized at said hydrocarbon extraction interface through solvent and thermal effects and removed through said production well;

accumulating within said extraction chamber condensed liquid solvent which is draining through the extraction chamber under the influence of gravity, which liquid solvent includes a hydrocarbon rich fluid production layer which is proximal to said extraction interface and comprises liquid solvent and mobile hydrocarbons and a hydrocarbon lean production layer which is remote from said hydrocarbon extraction interface, and comprises primarily liquid solvent; and heating a portion of said extraction chamber around said injection well to create a heated zone having a temperature above said condensation temperature without heating said hydrocarbon rich production layer to permit said hydrocarbon rich production layer to continue to drain to said production well.

2. The method according to claim 1, wherein said injection well and said production well are generally horizontal wells with the injection well being located above the production well.

3. The method according to claim 1, wherein said hot zone is created by using heat from one or more of an electric heater; hot tubing utilizing a circulating heating media; using super heat of the injected solvent vapour; using co-injection of steam; using a radio-frequency heater; using an induction or electromagnetic heater; or using a microwave heater.

4. The method according to claim 1, wherein said extraction chamber includes one or more observation wells having temperature sensors and the temperature readings are used to mange the amount of heat provided.

5. The method according to claim 1, wherein the rate of change in a solvent to oil ratio is monitored and used at least in part to determine how much heat to add.

6. The method according to claim 1, wherein the change in solvent inventory is monitored and used at least in part to determine how much heat to add.

7. The method according to claim 1, wherein the production rate of hydrocarbons is monitored and used, at least in part, to determine how much heat to add.

8. The method according to claim 1, wherein said solvent is capable of condensing at a pressure in an underground hydrocarbon bearing formation and at a temperature above naturally occurring reservoir temperatures.

9. The method according to claim 8, wherein said condensation pressure is up to a native reservoir pressure.

10. The method according to claim 8, wherein said pressure is up to, but below, a fracture pressure for said reservoir.

11. The method according to claim 1, wherein said solvent is selected from the group consisting of propane, butane, dimethyl ether, pentane, ethane, H2S, ammonia, COS, light ether, and aromatic compositions thereof, in any combination of one or more of said solvents.

12. A method of reducing a solvent to oil ratio in a condensing solvent extraction process comprising the steps of:

establishing an extraction chamber around a horizontal well pair within a pay zone in an underground hydrocarbon bearing formation, the extraction chamber including drainage layers of mixed solvent and hydrocarbon fluids adjacent to an extraction interface;

supplying heat to an extracted area of said chamber around said injection well to form a hot zone to vapourize at least some liquid solvent within said hot zone, and limiting said supplied heat to prevent the entire hot zone from extending to said drainage layers.

13. The method according to claim 12, wherein said hot zone is created by using heat from one or more of an electric heater; hot tubing utilizing a circulating heating media; using super heat of the injected solvent vapour; using co-injection of steam; using a radio-frequency heater; using an induction or electromagnetic heater; or using a microwave heater.

14. The method according to claim 12, wherein said extraction chamber includes one or more observation wells having temperature sensors and the temperature readings are used to mange the amount of heat provided.

15. The method according to claim 12, wherein the rate of change in a solvent to oil ratio is monitored and used at least in part to determine how much heat to add.

16. The method according to claim 12, wherein the change in solvent inventory is monitored and used at least in part to determine how much heat to add.

17. The method according to claim 12, wherein the production rate of hydrocarbons is monitored and used, at least in part, to determine how much heat to add.

18. The method according to claim 12, wherein said solvent is capable of condensing at a pressure in said underground hydrocarbon bearing formation and at a temperature above naturally occurring reservoir temperatures.

19. The method according to claim 18, wherein said condensation pressure is up to a native reservoir pressure.

20. The method according to claim 18, wherein said pressure is up to, but below, a fracture pressure for said reservoir.

21. The method according to claim 12, wherein said solvent is selected from the group consisting of propane, butane, dimethyl ether, pentane, ethane, H2S, ammonia, COS, light ether, and aromatic compositions thereof, in any combination of one or more of said solvents.

22. A method of reducing a solvent to oil ratio for a condensing solvent extraction process used for in situ hydrocarbon extraction from an underground formation, the method comprising the steps of:

establishing an in-situ extraction chamber having an extraction interface at the edge of the extraction chamber;

injecting a condensing solvent into the extraction chamber in a manner to establish a bubble point condition at said extraction interface;

establishing a gravity drainage flow path along said extraction interface to a production well;

providing additional heat to a region within said extraction chamber remote from said extraction interface and said gravity drainage flow path; and controlling the supply of said additional heat to preserve said bubble point condition at the extraction interface and along said gravity drainage flow path; and wherein the step of providing additional heat comprises co-injecting a vapour energy carrier with said solvent.

23. The method according to claim 22, wherein the step of providing additional heat comprises using super heated solvent vapour.

24. The method according to claim 22, wherein the step of providing additional heat comprises using downhole electrical resistance heating.

25. The method according to claim 24, wherein the electrical resistance heating is configured to lower the extraction energy required per barrel of oil as compared to the extraction energy required per barrel of oil when using super heated solvent.

26. The method according to claim 22, wherein the step of co-injecting a vapour energy carrier includes co-injecting steam.

27. The method according to claim 26, further comprising the step of forming two vapour chambers inside said extraction chamber, said two vapour chambers comprising an inner vapour chamber for receiving said injected condensing solvent, and an outer vapour chamber surrounding said inner vapour chamber;

wherein a chamber interface is located between said inner vapour chamber and said outer vapour chamber, said chamber interface being defined by a temperature drop from a temperature of said inner vapour chamber to a temperature below a saturation temperature for said steam.

28. The method according to claim 26, wherein said extraction chamber includes pore spaces occupied at least in part by condensed steam.

29. The method according to claim 27, wherein said temperature of said inner vapour chamber is above a saturation temperature for said solvent.

30. The method according to claim 22, further including the step of providing substantially pure solvent to remove non-condensable gases from said extraction interface.

31. The method according to claim 30, wherein water recovered by said extraction process from said underground formation is used to generate the steam for recycling back into said underground formation.

* * * * *